US005529663A

United States Patent [19]

Springer

[11] Patent Number: 5,529,663

[45] Date of Patent: Jun. 25, 1996

[54] DELIGNIFICATION OF LIGNOCELLULOSIC MATERIALS WITH PEROXYMONOPHOSPHORIC ACID

[75] Inventor: Edward L. Springer, Madison, Wis.

[73] Assignee: The United States of America as represented by the Secretary of Agriculture, Washington, D.C.

[21] Appl. No.: 415,884

[22] Filed: Apr. 3, 1995

[51] Int. Cl.[6] ..... D21C 3/04; D21C 9/16

[52] U.S. Cl. ..... 162/76; 162/78

[58] Field of Search ..... 162/76, 78, 80, 162/90; 8/111

[56] References Cited

U.S. PATENT DOCUMENTS

| | | | |
|---|---|---|---|
| 4,666,622 | 5/1987 | Martin et al. | 252/99 |
| 5,004,523 | 4/1991 | Springer et al. | 162/76 |

OTHER PUBLICATIONS

Christopher J. Biermann, "Essentials of Pulping and Papermaking", Department of Forest Products and Center for Advanced Materials Research, Oregon, 1993, pp. 81–82, 86–87.

Sven A. Rydholm, "Pulping Process", Forest Products Laboratory, Wisconsin, 1965, pp. 308–309, pp. 674–675, 677.

Edward L. Springer, "Potential uses for Peroxymonosulfate in Pulping and Bleaching", Proceedings of the 1989 and 1990 Alche Forest Products Symposium, San Francisco, Chicago, and Atlanta, pp. 113–116.

Edward L. Srpinger, "Delignification of Aspen Wood with Pernitric Acid", Jun. 1994, Tappi Journal, vol. 77, No. 6, pp. 103, 108.

James P. Casey, "Pulp and Paper Chemistry and Chemical Technology", Forest Products Laboratory, Third Edition, vol. I. Wisconsin, p. 162.

G. A. Smook, Handbook for Pulp & Paper Technologists, Atlanta and Georgia, 1989, pp. 37–39.

Edward L. Springer, "Delignification of Aspen Wood Using Hydrogen Peroxide and Peroxymonosulfate", Jan. 1990, Tappi Journal, p. 175.

Edward L. Springer and James L. Minor, "Delignification of Wood Fibers with Peroxymonosulfate", Paper and Timber, p. 968.

Edward L. Springer and James L. Minor, "Improved Penetration of Pulping Reagents into Wood", Paper and Timber, 1993, vol. 75, No. 4.

"Bleached Pulp by Peroxyacid/Alkaline Peroxide Delignification", Paper and Timber, 1986.

*Primary Examiner*—Donald E. Czaja
*Assistant Examiner*—Dean T. Nguyen
*Attorney, Agent, or Firm*—Janet I. Stockhausen; M. Howard Silverstein; John D. Fado

[57] ABSTRACT

Disclosed is a method for the delignification of lignocellulosic materials with acidic solutions of peroxymonophosphoric acid for the delignification and brightening of cellulosic pulps in bleaching; for the production of cellulosic pulps for use in paper making and in regenerated cellulose products; for enhancing the properties of recycled cellulosic fibers and for use in animal feeds and other products where removal or degradation of lignin is beneficial.

17 Claims, No Drawings

DELIGNIFICATION OF LIGNOCELLULOSIC MATERIALS WITH PEROXYMONOPHOSPHORIC ACID

BACKGROUND OF THE INVENTION

This invention describes new and useful methods for the degradation and removal of lignin from lignocellulosic materials; to delignify and brighten cellulosic pulps in bleaching; to produce cellulosic pulps for use in paper and paperboard manufacture and the manufacture of regenerated cellulose products; to enhance the strength, optical properties and other properties of recycled cellulosic fibers; to produce fodders having increased digestibility to ruminants; and to produce any other product in which the: degradation of or the removal of lignin from a lignocellulosic material produces beneficial results.

Lignocellulosic materials is a broad term that can be applied to a wide range of materials generally derived from plants or other organic sources. A primary example of such a material is wood. As is generally true for lignocellulosics, wood is composed of two main parts-a fibrous carbohydrate or cellulosic portion, and a non-fibrous portion comprising a complex chemical, commonly referred to as lignin. A major economic use of wood is derived from the conversion of the wood into a form suitable for the manufacture of paper, paperboard, and other related products. Despite the economic importance of the industry that is founded on the conversion of the lignocellulosic content of wood into paper, the basic processes for delignifying wood, or significantly reducing its lignin content, for papermaking apply to all processes for which the purpose is to enhance the value or utility of a lignocellulosic material by modification of or reduction of its lignin content.

For use in paper-making processes, wood must first be reduced to pulp, which can be defined as wood fibers capable of being slurried or suspended and then deposited on a screen to form a sheet. The methods used to accomplish this pulping usually involve either a physical or chemical treatment of the wood or perhaps some combination of the two processes, to alter its physical and chemical form to give the desired paper properties.

Current industrial processes for pulping wood and other sources of lignocellulosic material such as annual plants, and for bleaching the resultant pulp, have evolved slowly over many decades. Although these processes are quite complex and energy-intensive, they are relatively efficient. Their major disadvantage is that the chemical processes involved have the capacity to create a negative impact on the environment. Even the best of current technology is unable to completely suppress the odors emitted by pulp mills, or to completely eliminate the emission of chlorinated organic compounds from waste treatment plants associated with pulp mill bleach plants. The discovery of new methods for more easily or more effectively modifying or delignifying wood such as those disclosed herein can lead to the development of new, more efficient, less environmentally troublesome pulping and bleaching processes.

Pulping is achieved by chemical or mechanical means or combinations of the two. In mechanical pulping, the original constituents of the fibrous material are essentially unchanged, except for the removal of water soluble constituents. Chemical pulping, in contrast, has as its purpose the selective removal of the fiber-bonding lignin to a varying degree, while minimizing the degradation and dissolution of the hemicelluloses and cellulose. If the ultimate purpose of the pulp is the preparation of white papers, the purification process begun through initial pulping is continued in subsequent bleaching steps. The bleaching process can result not only in a brightening of the resulting pulp, but also a further reduction in the lignin content of the pulp. The properties of the end products of the pulping/bleaching process such as, for example, papers and paperboards, will be determined largely by the properties of the pulps that are used in their manufacture. The properties of the pulps, in turn, are determined by the particular pulping processes employed, as well as the identity of the wood species or non-wood plant fiber lignocellulosic used as the raw material for the pulp.

A pulp produced solely by chemical methods is referred to as a full chemical pulp. In practice, chemical pulping methods are successful in removing most of the lignin; they also degrade a certain amount of the hemicellulose and cellulose so that the yield of pulp is low relative to mechanical pulping, usually between 40 and 50% of the original wood substance, with a residual lignin content on the order of 3–5%. These pulps can be characterized as high strength pulps, although their production can be costly both in terms of the consumption of chemicals in the process, as well as the loss of hemicellulose and cellulose content from the starting materials.

In typical chemical pulping, wood physically reduced to a chip form is cooked with the appropriate chemicals in an aqueous solution, generally at elevated temperature and pressure. The energy and other process costs associated with reaction processes at elevated temperatures and pressures constitute significant disadvantages for conventional pulping processes. The two principal methods are the (alkaline) kraft process and the (acidic) sulfite process. The kraft process has come to occupy the dominant position because of advantages in chemical recovery and pulp strength. The sulfite process was more common up to 1930, before the advent of the widespread use of the kraft process, although its use has increased somewhat in recent years.

The kraft process involves cooking wood chips in a solution of sodium hydroxide (NaOH) and sodium sulfide ($Na_2S$). The alkaline attack causes a breaking of the lignin molecule into smaller segments whose sodium salts are soluble in the cooking liquor. Kraft pulps produce strong paper products ("kraft" is the German word for strength), but the unbleached pulp is characterized by a dark brown color. The kraft process is associated with malodorous gases, principally organic mercaptans and sulfides, which cause environmental concern, to which anyone who has been in the olfactory proximity of a kraft pulp mill can attest.

The kraft process evolved over 100 years ago from soda cooking (which utilizes only sodium hydroxide as the active chemical), when Carl S. Dahl, a German chemist, introduced sodium sulfate into the chemical cooking system as a makeup chemical. Actual conversion to sodium sulfide ($Na_2S$) in the resultant cooking liquor produced a dramatic improvement in reaction kinetics and pulp properties when cooking softwoods. The fact that sodium sulfate is commonly used as a makeup chemical is the reason that the kraft process is sometimes called the "sulfate process". The process uses the combination of sodium hydroxide and sodium sulfide at a pH in excess of 12, at 160–180° C. (320°–356° F.), corresponding to about 800 kPa (120 psi) steam pressure, for 0.5–3 hours to degrade and dissolve much of the lignin of the wood fibers. The comparative strength of the resulting pulp arises from the use of an alkaline sulfide solution and the shorter cooking times which, in turn, lead to less cellulose degradation. Despite a certain number of distinct disadvantages, not the least of which are the energy costs imposed by typical reaction conditions, about 75–80% of U.S. virgin pulp is produced by this process.

In the alternative sulfite process, a mixture of sulfurous acid ($H_2SO_3$) and bisulfite ion ($HSO_3$–) is used to attack and solubilize the lignin component of the lignocellulosic starting material. Here, the mechanism of chemical attack removes the lignin as salts of lignosulfonic acid, and the molecular structure, although fragmented, is left largely intact. The cations for the bisulfite can be calcium, magnesium, sodium, or ammonium. Sulfite pulping can be carried out over a wide range of pH. "Acid sulfite" denotes pulping with an excess of free sulfurous acid (pH 1–2), while "bisulfite" cooks are carried out under less acidic conditions (pH 3–5).

Sulfite pulps are lighter in color than kraft pulps and can be bleached more easily, but the paper sheets are weaker than equivalent kraft sheets. The sulfite process works well for such softwoods as spruce, fir and hemlock, and such hardwoods as poplar and eucalyptus; but resinous softwoods and tannin-containing hardwoods are more difficult to handle. This sensitivity to wood species, along with the weaker pulp strength and the greater difficulty in chemical recovery, are the major reasons for the decline of sulfite pulping relative to kraft. The trend towards whole tree chipping puts sulfite at a further disadvantage because of its intolerance to bark.

Although all delignification or chemical pulping processes have as their desired end result the significant reduction of the lignin content of the starting lignocellulosic material, the characteristics of the individual processes chosen to achieve that end bear considerably on the properties of the resulting products manufactured from that pulp. In general, although the chemical goal of pulping or delignification processes is the separation of the fibrous carbohydrate content of the lignocellulosic material from the lignin content, it is not always possible or even desirous to remove the entire lignin component from the lignocellulosic starting material. The extent to which any chemical pulping process is capable of degrading and solubilizing the lignin component of a lignocellulosic material while minimizing the accompanying degradation of cellulose and hemicellulose is referred to as the "selectivity" of the process.

Delignification selectivity is an important consideration during pulping and bleaching operations where it is desired to maximize removal of the lignin while retaining as much cellulose and hemicellulose as possible. One way of defining delignification selectivity in a quantitative fashion is as the ratio of lignin removal to carbohydrate removal during the delignification process. Although this ratio is seldom measured directly, it is measured in a relative manner by yield versus Kappa Number plots. Although the slope of two plots corresponding to two different pulping or delignification processes may be the same, the process which produces a higher yield, as measured by the amount of pulp in comparison to the amount of the starting material, for the same degree of delignification is considered to be the more selective process. A high selectivity alone, however, does not mean that pulp "A" is better than "B" since such plots do not indicate the strength or the viscosity of the pulp. For example, acid sulfite pulping is, by this definition more selective than kraft pulping; however, acid sulfite pulp is weaker than kraft pulp because the cellulose fibers are weaker due to acid hydrolysis.

Another way of defining selectivity is as the viscosity of the pulp at a given low lignin content. This is usually done by plotting pulp viscosity versus Kappa Number and comparing the viscosities of the pulps at a selected Kappa Number. The higher the viscosity, the more selective the delignification, or pulping process. In general, for a given process, the higher the viscosity the stronger the pulp. This sometimes does not apply when comparing pulps produced by different processes. For example, for a given low lignin content, acid sulfite pulp will be higher in yield and in pulp viscosity than kraft pulp; however, the kraft pulp will have higher strength properties.

In the sulfite process, sulfonation and acid hydrolysis contribute to delignification, and acid hydrolysis to carbohydrate degradation and dissolution. In the kraft process, mercaptation (sulfidation) and alkaline hydrolysis contribute to delignification, and alkaline peeling and hydrolysis to the carbohydrate degradation. The delignification proceeds more rapidly in the sulfite cook than in the kraft cook, and lower temperatures can therefore be used in the former, which is fortunate because the hydrolysis of the glycosidic bonds of the carbohydrates occurs much more rapidly in acidic than in alkaline medium. Alkaline peeling reactions, on the other hand, require lower temperature than the alkaline delignification, and they unavoidably decrease the carbohydrate yield, to a degree which depends on both chemical and physical changes in their structure. Accessibility phenomena improve the selectivity of lignin removal, partly because in the early stages of the cook the morphological structure protects the carbohydrates from being attacked by the pulping chemicals, especially in the sulfite cook, and partly because some of the hemicelluloses are capable of rearrangements to a more ordered and less accessible structure during the cook. The net result of all these phenomena is that softwood pulp yields at a certain degree of delignification are about 3–5% of the wood higher for the sulfite than for the kraft process, whereas hardwood pulp yield are fairly similar.

The methods described above for the delignification or pulping of lignocellulosic materials, although each possess certain practical advantages, can all be characterized as being hampered by significant disadvantages. Thus, there exists a need for delignification or pulping processes which are advantageous economically, either in terms of cellulosic yield of the process or in terms of the chemical or process technology costs of the method; which are environmentally benign; which produce delignified materials of superior properties; and which are applicable to a wide variety of lignocellulosic materials. Such processes, as exemplified by the invention disclosed herein, have the added advantage of wide applicability well beyond the area of pulping.

SUMMARY OF THE INVENTION

Lignocellulosics such as wood, straw, sugar cane bagasse, reeds, kenaf, corn stover, flax and wood in various forms of separation or preparation, such as fiberized wood, wood meal, destructured wood chips or wood chips physically or chemically treated to enhance their porosity, can be effectively and, when desired, almost totally delignified by peroxymonophosphoric acid in solutions ranging from neutral or very mildly acidic, to strongly acidic. Even under strongly acidic conditions, a delignified residue with high viscosity, good strength properties, and high brightness can be obtained.

Therefore, in one aspect, the present invention provides a method of oxidatively treating a lignocellulosic material to decrease a content of lignin therein, the method comprising the steps of contacting the lignocellulosic material with a solution of peroxymonophosphoric acid at a temperature and for a time effective to substantially fragment the lignin; separating a solid residue from the solution; and extracting the lignin fragments from the residue. The lignocellulosic material treated according to the present invention is selected from the group consisting of wood, straw, sugar cane bagasse, reeds, corn stover, flax and prepared wood material. More preferably, the prepared wood material treated according to the present invention comprises porosity-enhanced wood chips, fiberized wood, chemical wood pulp, high yield pulp, waste paper, or recycled fibers.

In another aspect, practice of the method of the present invention occurs at a temperature in the range of 273K to 473K. Preferably, the temperature is in the range of 293K to 353K. In addition, according to the practice of the method of the invention, the lignocellulosic material is in contact with the solution of peroxymonophosphoric acid from about 0.1 to about 1200 hours. Preferably, the lignocellulosic material is in contact with the solution of peroxymonophosphoric acid from about 1 to about 600 hours. According to the method of the present invention, the concentration of peroxymonophosphoric acid in the solution contacting the lignocellulosic material is from about 0.1 to about 20 mass percent. Preferably, the concentration of peroxymonophosphoric acid is from about 1.0 to about 5.0 mass percent. According to this aspect of the invention, the pH of the peroxymonophosphoric acid solution used in the practice of the present invention is in the range of –0.5 to 7 pH units. Preferably, the pH of the peroxymonophosphoric acid solution is in the range of –0.3 to 5.0 pH units. Furthermore, according to the present invention, the peroxymonophosphoric acid solution to lignocellulosic material mass ratio is in the range of from 1:1 to 100:1. Preferably, the peroxymonophosphoric acid solution to lignocellulosic material mass ratio is in the range of from 2:1 to 50:1.

In another aspect of the present invention, the lignin extraction is carried out by a dilute alkaline solution. Preferably, the alkaline solution is a solution of sodium hydroxide or potassium hydroxide. Alternatively, the lignin extraction is carried out by a solution of ammonium hydroxide. More preferably, the method of the claimed invention comprises the additional steps of collecting liquors from the peroxymonophosphoric acid treatment step and from the lignin extraction step and applying these liquors as a fertilizer to appropriate crops and/or arable or forest land.

According to the method of the claimed invention, the lignin content of the lignocellulosic material can be decreased by about 5 to about 99 percent. Preferably, according to the method of the invention, the lignin content of the lignocellulosic material will be decreased by at least 30 percent. More preferably, the lignin content of the lignocellulosic material is decreased by at least 60 percent. More preferably still, the lignin content of the lignocellulosic material treated according to the method of the present invention is decreased by at least 90 percent.

In another aspect, the method of the claimed invention comprises the additional step of contacting the lignocellulosic material to be treated with a strongly acidic solution, or a solution of a metal chelating agent, draining the solution, and thoroughly washing with water prior to contacting the lignocellulosic material with the peroxymonophosphoric acid solution. Alternatively, the method of the claimed invention comprises the additional step of contacting the lignocellulosic material with a strongly alkaline solution prior to contacting the lignocellulosic material with the peroxymonophosphoric acid solution. In yet another aspect, the method of the invention comprises the additional step of first contacting the lignocellulosic material with a strongly alkaline solution prior to contacting the material with a strongly acidic solution, or a solution of a metal chelating agent, followed by draining, and thoroughly washing with water. In an alternative aspect, the present invention contemplates a method comprising the further step of bleaching the delignified residue.

In another embodiment, the present invention provides a method of oxidatively treating chemical pulps prepared by industry standard pulping processes, with the purpose of decreasing the lignin content of the pulp, and wherein the method improves the optical brightness of the pulp. According to this embodiment, the method comprises the steps of contacting the pulp with a solution of peroxymonophosphoric acid at a temperature and for a time effective to substantially fragment the lignin; separating a solid residue from the solution; and extracting the fragmented lignin from the residue. The method of the invention further contemplates that the bleached pulp would have an International Standard Organization (ISO) brightness of at least 40. Also contemplated by the claimed invention is a method comprising a further step of bleaching the delignified pulp. The method further provides that the pulp, treated according to the practice of the invention, would have an ISO brightness of at least 60 after the bleaching step.

In another aspect, practice of this alternative embodiment of the claimed invention occurs at a temperature in the range of 273K to 473K. Preferably, the temperature is in the range of 293K to 353K. In addition, according to the method of the invention, the pulp is in contact with the solution of peroxymonophosphoric acid from about 0.1 to about 1200 hours. Preferably, the pulp is in contact with the solution of peroxymonophosphoric acid from about 1 to about 600 hours. According to the method of the present invention, the concentration of peroxymonophosphoric acid in the solution contacting the pulp is from about 0.1 to about 20 mass percent. Preferably, the concentration of peroxymonophosphoric acid is from about 1.0 to about 5.0 mass percent. According to this embodiment of the invention, the pH of the peroxymonophosphoric acid solution used in the method of the invention is in the range of –0.5 to 7 pH units. Preferably, the pH of the peroxymonophosphoric acid solution is in the range of –0.3 to 5.0 pH units. Furthermore, according to this embodiment of the invention, the peroxymonophosphoric acid solution to chemical pulp mass ratio is in the range of from 1:1 to 100:1. Preferably, the peroxymonophosphoric acid solution to pulp mass ratio is in the range of from 2:1 to 50:1.

In another aspect of the present invention, the lignin extraction step of the method of the invention is carried out by a dilute alkaline solution. Preferably, the alkaline solution is a solution of sodium hydroxide or potassium hydroxide. Alternatively, the lignin extraction is carried out by a solution of ammonium hydroxide. More preferably, the method of the claimed invention comprises the additional steps of collecting liquors from the peroxymonophosphoric acid treatment step and from the lignin extraction step and applying these liquors as a fertilizer to appropriate crops and/or arable or forest land.

In the practice of this embodiment of the claimed invention, the lignin content of the chemical pulp can be decreased by about 5 to about 99 percent. Preferably, the lignin content of the pulp will be decreased by at least 30 percent. More preferably, the lignin content is decreased by at least 60 percent. More preferably still, the lignin content of the chemical pulp treated according to this embodiment of the claimed invention is decreased by at least 90 percent.

In another aspect, the method of the claimed invention comprises the additional step of contacting the chemical pulp to be treated with a strongly acidic solution, or a solution of a metal chelating agent, draining the solution, and thoroughly washing with water prior to contacting the pulp with the peroxymonophosphoric acid solution. Alternatively, the method of the claimed invention comprises the additional step of contacting the pulp with a strongly alkaline solution prior to contacting the pulp with the peroxymonophosphoric acid solution. In yet another aspect, the method of the invention comprises the additional step of first contacting the pulp with a strongly alkaline solution prior to contacting the material with a strongly acidic solution, or a solution of a metal chelating agent, followed by draining and thoroughly washing with water. In an alternative aspect, the present invention contemplates a method comprising the further step of bleaching the delignified pulp.

In an alternative embodiment, the present invention provides a method of oxidatively degrading the lignin component of a lignocellulosic material comprising contacting the lignocellulosic material with an solution of peroxymonophosphoric acid under conditions of temperature, time, and pH effective to degrade the lignin component. The lignocellulosic material treated according to this embodiment of present invention is selected from the group consisting of wood, straw, sugar cane bagasse, kenaf, reeds, corn stover, flax, prepared wood material, livestock fodder, and organic material of plant origin. Thus, the digestibility of such lignocellulosic material will be improved significantly.

In another aspect, practice of the method of this embodiment of the invention occurs at a temperature in the range of 273K to 473K. Preferably, the temperature is in the range of 293 K to 353K. In addition, according to the practice of the method of the invention, the lignocellulosic material is in contact with the solution of peroxymonophosphoric acid from about 0.1 to about 1200 hours. Preferably, the lignocellulosic material is in contact with the solution of peroxymonophosphoric acid from about 1 to about 600 hours. According to the method of the present invention, the concentration of peroxymonophosphoric acid in the solution contacting the lignocellulosic material is from about 0.1 to about 20 mass percent. Preferably, the concentration of peroxymonophosphoric acid is from about 1.0 to about 5.0 mass percent. According to this aspect of the invention, the pH of the peroxymonophosphoric acid solution used in the practice of the present invention is in the range of −0.5 to 7 pH units. Preferably, the pH of the peroxymonophosphoric acid solution is in the range of −0.3 to 5.0 pH units. Furthermore, according to the present invention, the peroxymonophosphoric acid solution to lignocellulosic material mass ratio is in the range of from 1:1 to 100:1. Preferably, the peroxymonophosphoric acid solution to lignocellulosic material mass ratio is in the range of from 2:1 to 50:1.

In another aspect, the method of the claimed invention comprises the additional step of contacting the lignocellulosic material to be treated with a strongly acidic solution, or a solution of a metal chelating agent, draining the solution and thoroughly washing with water prior to contacting the lignocellulosic material with the peroxymonophosphoric acid solution. Alternatively, the method of the claimed invention comprises the additional step of contacting the lignocellulosic material with a strongly alkaline solution prior to contacting the lignocellulosic material with the peroxymonophosphoric acid solution. In yet another aspect, the method of the invention comprises the additional step of first contacting the lignocellulosic material with a strongly alkaline solution prior to contacting the material with a strongly acidic solution, or a solution of a metal chelating agent, followed by a thorough washing with water.

DETAILED DESCRIPTION OF THE INVENTION

A preferred embodiment comprising a range of conditions is provided under A, below. In a broader embodiment of this invention, lignin is removed from lignocellulosics using an aqueous delignifying solution comprising peroxymonophosphoric acid according to the set of conditions listed below under B.

| | A. PREFERRED EMBODIMENT | B. RANGE OF EMBODIMENT |
|---|---|---|
| pH | −0.3 to 4.3 | −0.5 to 7 |
| $H_3PO_5$ % IN SOLUTION | 1.0 to 5.0 | 0.1 to 20 |
| LIQUOR TO LIGNOCELLULOSE RATIO | 2:1 to 50:1 | 1:1 to 100:1 |
| TIME, HRS. | 1 to 600 | 0.1 to 1200 |
| TEMPERATURE, °C. | 20 to 80 | 0 to 200 |

All types of lignocellulosic materials can be delignified by this method. By way of example, and without limitation, lignin can be removed from both light weight and dense hardwoods and softwoods, and from all kinds of non-woody species. Illustrative of these non-woody materials, without limitation, are grasses, cereal straws, bamboo, cornstalks, sugar cane bagasse, kenaf, hemp, jute, sisal, esparto, reeds and the like.

Organic peroxides, such as peracetic and performic acids, have been known to readily delignify wood and other lignocellulosic materials. With the exception of attention directed to the use of alkaline hydrogen peroxide, little attention has been directed toward the delignification of lignocellulosic materials with inorganic peroxides. Alkaline hydrogen peroxide can remove some lignin from lignocellulosics but, in general, it is quite ineffective in delignification. It has been determined that dilute solutions of the peroxymonosulfate anion, under acidic conditions and at low temperature (20°–50° C.) and atmospheric pressure, can be effective in delignification of wood. Such peroxymonosulfate treatment must be followed by an alkaline extraction to solubilize and remove the fragments of depolymerized lignin.

The present invention concerns the use of peroxymonophosphoric acid in place of organic peracids. The use of peroxymonophosphates in such fashion has not been previously suggested, nor have they been used in a way which would suggest to a pulp and paper chemist that peroxymonophosphates would perform in the pulping and bleaching of lignocellulosic materials in a fashion similar to that of organic peracids, or for that matter, that they may be employed under non-extreme conditions in the treatment of cellulose containing materials to assist in and improve the separation of non-cellulosic materials therefrom.

In the oxidative reaction of peroxymonophosphoric acid, $H_3PO$, with lignin in lignocellulosics to degrade the lignin or to delignify the lignocellulosic material, yielding a cellulose-enriched pulp, comparatively very little oxidant is used. This then makes possible the ready delignification of reduced-lignin chemical pulps in either a subsequent bleaching or a pre-bleaching treatment process. Such treatment yields very low lignin levels in the pulps so they can be efficiently and more effectively brightened to high levels.

Such processes also open the path for the treatment of porosity-enhanced wood chips, fiberized wood, high yield pulps, waste papers, recycled fibers and the like to enhance their properties, and thus their utilization. The peroxymonophosphoric acid treatment process of the present invention further opens the door to an economical method for delignifying lignocellulosics from agricultural and forest residues to enhance the enzymatic and ruminant digestibility of the residues.

In one aspect, the present invention provides a method of oxidatively treating a lignocellulosic material to decrease a content of lignin therein, the method comprising the steps of contacting the lignocellulosic material with a solution of peroxymonophosphoric acid at a temperature and for a time effective to substantially fragment the lignin; separating a solid residue from the solution; and extracting the lignin fragments from the residue. The lignocellulosic material treated according to the present invention is selected from the group consisting of wood, straw, sugar cane bagasse, kenaf, reeds, corn stover, flax and prepared wood material. More preferably, the prepared wood material treated according to the present invention comprises porosity-enhanced wood chips, fiberized wood, chemical wood pulp, high yield pulp, waste paper, or recycled fibers.

If wood is the lignocellulosic material to be delignified, it is preferable to use a pre-treatment to increase its permeability or, in the alternative, to use wood fiber, wood meal or destructured wood. Untreated wood chips are not easily penetrated by aqueous acidic solutions, and oxidizing agents produce a topochemical effect with chips because oxidant is consumed by lignin as it moves from the outside fibers inward. Unpre-treated wood chips may, however, be employed under conditions in which the outer reacted fibers are separate$_d$ from the chips and liquor during the digestion period.

Wood chips are not easily penetrated by acidic solutions. Also, heterogeneous pulping of chips is often observed with oxidizing reagents because high reactivity with lignin consumes oxidant as the liquor progresses from the outside fibers inward. More rapid, uniform reaction may be promoted by starting with a high-yield fiber or destructured chips. Wood fibers may be obtained in a relatively undamaged form by thermal softening of the middle lamella lignin and mechanically fiberizing. The lignin-coated fibers thus obtained are used commercially to produce hardboard and are referred to as hardboard fibers.

In another aspect, practice of the method of the present invention occurs at a temperature in the range of 273K to 473K. Preferably, the temperature is in the range of 293K to 353K. In addition, according to the practice of the method of the invention, the lignocellulosic material is in contact with the solution of peroxymonophosphoric acid from about 0.1 to about 1200 hours. Preferably, the lignocellulosic material is in contact with the solution of peroxymonophosphoric acid from about 1 to about 600 hours. According to the method of the present invention, the concentration of peroxymonophosphoric acid in the solution contacting the lignocellulosic material is from about 0.1 to about 20 mass percent. Preferably, the concentration of peroxymonophosphoric acid is from about 1.0 to about 5.0 mass percent. According to this aspect of the invention, the pH of the peroxymonophosphoric acid solution used in the practice of the present invention is in the range of −0.5 to 7 pH units. Preferably, the pH of the peroxymonophosphoric acid solution is in the range of −0.3 to 5.0 pH units. Furthermore, according to the present invention, the peroxymonophosphoric acid solution to lignocellulosic material mass ratio is in the range of from 1:1 to 100:1. Preferably, the peroxymonophosphoric acid solution to lignocellulosic material mass ratio is in the range of from 2:1 to 50:1.

The discovery of the delignifying ability of peroxymonphosphate solutions across a wide range of pH makes possible a broad spectrum of potential end-uses for these solutions in pulping and bleaching. Such solutions can be used to treat wood or other lignocellulosics to produce chemical-type pulps or to treat mechanical, thermomechanical, chemimechanical, or chemithermomechanical pulps to improve their strength properties. These solutions can be used to restore or improve the strength of secondary fiber from unbleached softwood kraft wastepaper, old corrugated containers, or old newsprint. Peroxymonophosphate can also be used as a replacement for chlorine and chlorine dioxide in pulp bleaching or as a pretreatment prior to oxygen delignification or bleaching.

In another aspect of the present invention, the lignin extraction is carried out by a dilute alkaline solution. Preferably, the alkaline solution is a solution of sodium hydroxide or potassium hydroxide. Alternatively, the lignin extraction is carried out by a solution of ammonium hydroxide. More preferably, the method of the claimed invention comprises the additional steps of collecting liquors from the peroxymonophosphoric acid treatment step and from the lignin extraction step and applying these liquors as a fertilizer to appropriate crops and/or arable or forest land.

Spent treating liquor from peroxymonophosphate delignification can contain a large amount of acid together with some degraded lignin fragments and carbohydrate fragments. However, most lignin and carbohydrate fragments would be in the alkaline extraction liquor. As is possible for nitric acid pulping, the treating liquor can be recycled back to the treating stage, and reinforced with fresh peroxymonophosphate several times before disposal. After several uses, the liquor could be neutralized with spent extraction liquor and used as a fertilizer.

Alternative means may be used to dispose of the spent extraction liquor. If the extraction is performed using sodium hydroxide, the spent extraction liquor can be evaporated and burned as in the kraft recovery cycle. However, this process requires multistage evaporators and a recovery furnace, a very large capital expense. If the extraction is performed using ammonium hydroxide or potassium hydroxide, the spent extraction liquors can be used as fertilizer. Ammonium hydroxide extraction liquors from nitric acid pulping have been shown to have no deleterious effects on plant growth and to act as an effective fertilizer.

Through the use of ammonium hydroxide or potassium hydroxide in the extraction stage and the subsequent use of spent extraction liquor as a fertilizer, the peroxymonophosphate delignification method is relatively low cost and much more environmentally compatible than the kraft process. The spent extraction liquors mixed with, and thus used to neutralize, the initial treating liquors can be spread on farm fields or in forests.

According to the method of the claimed invention, the lignin content of the lignocellulosic material can be decreased by about 5 to about 99 percent. Preferably, according to the method of the invention, the lignin content of the lignocellulosic material will be decreased by at least 30 percent. More preferably, the lignin content of the lignocellulosic material is decreased by at least 60 percent. More preferably still, the lignin content of the lignocellulosic material treated according to the method of the present invention is decreased by at least 90 percent.

In another aspect, the method of the claimed invention comprises the additional step of contacting the lignocellulosic material to be treated with a strongly acidic solution, or a solution of a metal chelating agent such as (ethylenediaminetetraacetic acid) EDTA, (diethylenetriaminepentaacetic acid) DTPA or (diethylenetriaminepentamethylene phosphoric acid) DTMPA, draining the solution and thoroughly washing with water prior to contacting the lignocellulosic material with the peroxymonophosphoric acid solution. Alternatively, the method of the claimed invention comprises the additional step of contacting the lignocellulosic material with a strongly alkaline solution prior to contacting the lignocellulosic material with the peroxymonophosphoric acid solution. In yet another aspect, the method of the invention comprises the additional step of first contacting the lignocellulosic material with a strongly alkaline solution prior to contacting the material with a strongly acidic solution or a solution of a metal chelating agent, followed by thorough washing.

The practice of the present invention contemplates the use of strongly acidic solution in the pretreatment of lignocellulosics prepared from strong mineral acids such as, by way of example and without limitation, sulfuric acid or nitric acid. As would be understood by one of skill in the appropriate chemical arts, it would also be possible to prepare a strongly acidic pre-treating solution from a limited number of organic acids in addition to the mineral acids discussed immediately above. However, such acids would have to be chosen by their ability to dissociate in solution resulting in a sufficiently high concentration of acidic protons relative to the concentration of undissociated acid molecules. In an analogous fashion, strongly basic solutions used for pretreatment of lignocellulosics, either alone or in combination with strongly acidic solutions, are contemplated to be prepared from typical strongly alkaline species such as sodium hydroxide (NaOH) or potassium hydroxide (KOH). However, any species capable of producing a sufficiently high pH in solution would be appropriate provided that there would be no significant prospect for participating in potentially competing or interfering side reactions deleterious to the pretreatment or delignification processes. In an alternative aspect, the present invention contemplates a method comprising the further step of bleaching the delignified residue.

In another embodiment, the present invention provides a method of oxidatively treating chemical pulps prepared by industry standard pulping processes, with the purpose of decreasing the lignin content of the pulp, and wherein the method improves the optical brightness of the pulp. According to this embodiment, the method comprises the steps of contacting the pulp with a solution of peroxymonophosphoric acid at a temperature and for a time effective to substantially fragment the lignin; separating a solid residue from the solution; and extracting the fragmented lignin from the pulp. The method of the invention further contemplates that the treated pulp would have an ISO brightness of at least 40. Also contemplated by the claimed invention is a method comprising a further step of bleaching the delignified pulp. The method further provides that the pulp, treated according to the practice of the invention, would have an ISO brightness of at least 60 after the bleaching step.

The use of peroxymonophosphate for at least partial delignification and bleaching of pulps and other delignification residues can greatly reduce the quantity of chlorinated organics and of dioxins and dibenzofurans in effluent. Because no halogens are present in the spent liquor from the initial stage or in the liquor from the following alkaline extraction stage, these liquors can be sent to chemical recovery.

Peroxymonophosphate can be used to replace the chlorine dioxide stages in bleaching. The replacement of both chlorination and chlorine dioxide stages through use of peroxymonophosphate means that all spent liquors from a bleach plant can be sent to chemical recovery with no environmentally troublesome materials emerging from the bleach plant. The bleach plant is currently the major source of effluents from a bleached kraft pulp mill that require subsequent treatment to render them relatively environmentally benign.

Oxidative pre-treatments of unbleached softwood kraft pulps prior to oxygen delignification generally allow greater lignin removal in the oxygen stage before serious pulp strength loss occurs. In this vein, it has been shown that oxidating agents such as chlorine, chlorine dioxide, and nitrogen dioxide can be effective in pretreatment. Peroxymonphosphate can also be used in such pretreatment. The advantages of peroxymonophosphate are that it contains no halogens and that it can be used in solution, unlike nitrogen dioxide. Peroxymonophosphate pretreatment makes it possible to reduce lignin to a level as low as 1 percent in the subsequent oxygen stage before serious strength loss occurs.

In another aspect, practice of this alternative embodiment of the claimed invention occurs at a temperature in the range of 273K to 473K. Preferably, the temperature is in the range of 293K to 353K. In addition, according to the method of the invention, the pulp is in contact with the solution of peroxymonophosphoric acid from about 0.1 to about 1200 hours. Preferably, the pulp is in contact with the solution of peroxymonophosphoric acid from about 1 to about 600 hours. According to the method of the present invention, the concentration of peroxymonophosphoric acid in the solution contacting the pulp is from about 0.1 to about 20 mass percent. Preferably, the concentration of peroxymonophosphoric acid is from about 1.0 to about 5.0 mass percent. According to this embodiment of the invention, the pH of the peroxymonophosphoric acid solution used in the method of the invention is in the range of –0.5 to 7 pH units. Preferably, the pH of the peroxymonophosphoric acid solution is in the range of –0.3 to 5.0 pH units. Furthermore, according to this embodiment of the invention, the peroxymonophosphoric acid solution to chemical pulp mass ratio is in the range of from 1:1 to 100:1. Preferably, the peroxymonophosphoric acid solution to pulp mass ratio is in the range of from 2:1 to 50:1.

In another aspect of the present invention, the lignin extraction step of the method of the invention is carried out by a dilute alkaline solution. Preferably, the alkaline solution is a solution of sodium hydroxide or potassium hydroxide. Alternatively, the lignin extraction is carried out by a solution of ammonium hydroxide. More preferably, the method of the claimed invention comprises the additional steps of collecting liquors from the peroxymonophosphoric acid treatment step and from the lignin extraction step and applying these liquors as a fertilizer to appropriate crops and/or arable or forest land.

In the practice of this embodiment of the claimed invention, the lignin content of the chemical pulp can be decreased by about 5 to about 99 percent. Preferably, the lignin content of the pulp will be decreased by at least 30 percent. More preferably, the lignin content is decreased by at least 60 percent. More preferably still, the lignin content of the chemical pulp treated according to this embodiment of the claimed invention is decreased by at least 90 percent. In another aspect, the method of the claimed invention comprises the additional step of contacting the chemical pulp to be treated with a strongly acidic solution, or a solution of a chelating agent such as EDTA or DTPA, draining the solution and thoroughly washing with water prior to contacting the pulp with the peroxymonophosphoric acid solution.

In an alternative embodiment, the present invention provides a method of oxidatively degrading the lignin component of a lignocellulosic material comprising contacting the lignocellulosic material with an solution of peroxymonophosphoric acid under conditions of temperature, time, and pH effective to degrade the lignin component. The lignocellulosic material treated according to this embodiment of present invention is selected from the group consisting of wood, straw, sugar cane bagasse, kenaf,reeds, corn stover, flax, prepared wood material, livestock fodder, and organic material of plant origin.

Although across the world a great quantity of plant organic material is regularly produced, a significant portion of that organic material has little use nor value today. Substantially all plant organic material includes the combination of cellulose and lignin in various compositions and structural arrangements. The lignocellulose material is digestible at varying efficiencies by different animals. For instance, grass is a lignocellulosic material, the cellulose content of which is readily digestible by ruminants. Humans, however, cannot digest grass at a sufficiently high level to maintain body weight and therefore must depend upon a higher order of digestible organic material, such as grain. Other animals, such as beavers, can successfully digest lignocellulose, like tree bark, at a sufficient rate to maintain growth, whereas agricultural livestock such as cattle, sheep, horses and swine, cannot subsist on a diet of tree bark. Even among agricultural animals, the digestive systems vary to an extent wherein cattle and other ruminants can effectively utilize plant organic material having a lignocellulosic composition which will not be useful for horses or swine.

The human population continues to grow at such a rate that the grain producing potential of the world is becoming overtaxed. Furthermore, the diversion of grain to agricultural animals to produce meat results in a net calorie loss in terms of human food consumption. This threat of possible famine exists in spite of a huge quantity of plant organic material in the forests and jungles of the world. If the digestibility of plant organic material can be increased significantly, then forests and jungles can produce sufficient food for the world's increasing population. Lignin degradation with peroxymonophosphoric acid, with or without subsequent extraction, increases the digestibility of such plant organic matter.

In another aspect, practice of the method of this embodiment of the invention occurs at a temperature in the range of 273K to 473K. Preferably, the temperature is in the range of 293K to 353K. In addition, according to the practice of the method of the invention, the lignocellulosic material is in contact with the solution of peroxymonophosphoric acid from about 0.1 to about 1200 hours. Preferably, the lignocellulosic material is in contact with the solution of peroxymonophosphoric acid from about 1 to about 600 hours. According to the method of the present invention, the concentration of peroxymonophosphoric acid in the solution contacting the lignocellulosic material is from about 0.1 to about 20 mass percent. Preferably, the concentration of peroxymonophosphoric acid is from about 1.0 to about 5.0 mass percent. According to this aspect of the invention, the pH of the peroxymonophosphoric acid solution used in the practice of the present invention is in the range of −0.5 to 7 pH units. Preferably, the pH of the peroxymonophosphoric acid solution is in the range of −0.3 to 5.0 pH units. Furthermore, according to the present invention, the peroxymonophosphoric acid solution to lignocellulosic material mass ratio is in the range of from 1:1 to 100:1. Preferably, the peroxymonophosphoric acid solution to lignocellulosic material mass ratio is in the range of from 2:1 to 50:1.

According to the method of this embodiment of the claimed invention, the lignin content of the lignocellulosic material can be decreased by about 5 to about 99 percent. Preferably, according to the method of the invention, the lignin content of the lignocellulosic material will be decreased by at least 30 percent. More preferably, the lignin content of the lignocellulosic material is decreased by at least 60 percent. More preferably still, the lignin content of the lignocellulosic material treated according to the method of the present invention is decreased by at least 90 percent.

In another aspect, the method of the claimed invention comprises the additional step of contacting the lignocellulosic material to be treated with a strongly acidic solution, or a solution of a metal chelating agent, draining the solution and thoroughly washing with water prior to contacting the lignocellulosic material with the peroxymonophosphoric acid solution. Alternatively, the method of the claimed invention comprises the additional step of contacting the lignocellulosic material with a strongly alkaline solution prior to contacting the lignocellulosic material with the peroxymonophosphoric acid solution. In yet another aspect, the method of the invention comprises the additional step of first contacting the lignocellulosic material with a strongly alkaline solution prior to contacting the material with a strongly acidic solution, or a solution of a metal chelating agent, draining the solution and thoroughly washing with water.

EXAMPLES

Examples of delignification with peroxymonophosphate are given below:

Example 1

Delignification of Aspen Wood without Pretreatment.

Run 1

Peroxymonophosphoric acid was prepared as follows: 1.25 g of potassium peroxydiphosphate was dissolved in 26.3 g distilled, reverse-osmosis water, and 7.5 g of 70% nitric acid was added. This mixture was reacted in a 50° C. water bath for 30 minutes, and then cooled, yielding a solution containing 1.0% peroxymonophosphoric acid. The solution was analyzed using the art-recognized method of Greenspan, F. P. and MacKellar, D. G., *Analytical Chemistry* 20 (11): 106 (1948).

Aspen wood meal, 1.07 g air dried (5.9% moisture) which passed through a 40-mesh screen, was mixed with 25.1 g of the above solution and held at room temperature (22° C.) for 16 hours. The mixture was then filtered using a sintered glass crucible and the filtrate analyzed for peroxymonophosphoric acid as above. The solid residue was mixed with 1% sodium hydroxide solution at 50° C., and held for 20 minutes. This was repeated three times, and then the residue was filtered and washed with reverse-osmosis water until the water displayed a neutral pH. The residue was finally vacuum oven dried at 60° C. for 16 hours, weighed and analyzed. Results for this Run and for all other runs of Example 1 are given in Table I.

Run 2

Peroxymonophosphoric acid was prepared and analyzed as in Example 1, but using the following initial mixture:

| | |
|---|---|
| 2.00 g | potassium peroxydiphosphate; |
| 6.0 g | 70% nitric acid; |
| 20.3 g | distilled reverse-osmosis water. |

This produced a solution containing 1.9% peroxymonophosphoric acid. The solution and aspen wood meal were mixed, reacted, filtered, extracted, washed, dried and analyzed as in Run 1.

Run 3

Peroxymonophosphoric acid was prepared and analyzed as in Example 1, but using the following initial mixture:

| | |
|---|---|
| 2.00 g | potassium peroxydiphosphate; |
| 3.0 g | 70% nitric acid; |
| 10.3 g | distilled reverse-osmosis water. |

This produced a solution containing 3.8% peroxymonophosphoric acid. The delignification of the aspen wood meal was then carried out as in Run 1, except that only 10.4 g of the solution was added to 1.06 g of the milled wood.

Run 4

Peroxymonophosphoric acid was prepared and analyzed as in Run 1, but using the following initial mixture:

| | |
|---|---|
| 3.90 g | potassium peroxydiphosphate; |
| 6.0 g | 70% nitric acid; |
| 20.2 g | distilled reverse-osmosis water. |

This produced a solution containing 3.8% peroxymonophosphoric acid. The delignification was then carried out as in Run 1, except that the reaction time was 6.0 hours.

Run 5

Peroxymonophosphoric acid was prepared and analyzed as in Example. 1, but using the following initial mixture:

| | |
|---|---|
| 3.90 g | potassium peroxydiphosphate; |
| 6.8 g | 97% sulfuric acid; |
| 19.3 g | distilled reverse-osmosis water. |

This produced a solution containing 3.2% peroxymonophosphoric acid. The delignification was then carried out as in Run 1, except that the reaction time was 22 hours.

Run 6

Peroxymonophosphoric acid was prepared and analyzed as in Run 5. The delignification was carried out as in Run 1, except that the reaction time was 48 hours.

Run 7

Peroxymonophosphoric acid was prepared and analyzed as in Run 1, but using the following initial mixture:

| | |
|---|---|
| 7.82 g | potassium peroxydiphosphate; |
| 12.0 g | 70% nitric acid; |
| 40.2 g | distilled reverse-osmosis water. |

This produced a solution containing 3.8% peroxymonophosphoric acid the delignification was carried out as in Run 1, except that 50.0 g of cooled solution was added to 1.06 g of aspen meal, and the reaction time was 4 hours.

Run 8

Peroxymonophosphoric acid was prepared and analyzed as in Run 1, but using the following initial mixture:

| | |
|---|---|
| 3.90 g | potassium peroxydiphosphate; |
| 6.0 g | 70% nitric acid; |
| 18.1 g | distilled reverse-osmosis water. |

After cooling, 1.7 g of sodium hydroxide was added to the reacted mixture to produce a pH of 2.2 and the solution was then analyzed. It contained 3.8% peroxymonophosphoric acid. This solution was used to delignify milled aspen wood as in Run 1, except that a reaction time of 600 hours was employed.

Run 9

Peroxymonophosphoric acid was prepared as in Run 8, except that after cooling, 2.0 g of sodium hydroxide was added to the reacted mixture to give a pH of 4.3. The solution contained 3.8% peroxymonophosphoric acid and was used to delignify milled aspen wood as in Run 1, except that the reaction time was 169 hours.

Example 2

Delignification of Aspen Wood with Acid Pretreatment

Run 10

Since it was expected that an acid pre-treatment prior to peroxymonophosphate delignification would decrease the degradation of the wood carbohydrates, such a pre-treatment was employed in Runs 10 through 14. This pre-treatment was performed as follows: 15 g of a pH 0.9 sulfuric acid solution (made by adding 0.67 g of 97% sulfuric acid to 99 g distilled reverse-osmosis water) was added to 1.06 g of air-dried milled aspen wood. The mixture was held for 30 minutes at room temperature and then filtered using a sintered glass crucible. The residue was then washed several times with distilled reverse-osmosis water and air-dried for three days. The air-dried residue was then delignified employing exactly the same techniques and conditions as in Run 3 of Example 1. Results for this Run and all other runs of this Example are given in Table I.

Run 11

Acid pre-treatment was performed exactly as in Run 10. The air-dried residue was then delignified applying exactly the same conditions as in Run 4.

Run 12

Acid pre-treatment and delignification were performed exactly as in Run 11, except that the reaction time employed was hours.

Run 13

Acid pre-treatment was performed exactly as in Run 10. The air-dried residue was then delignified applying exactly the same conditions as in Run 7.

Run 14

Acid pre-treatment was performed exactly as in Run 10. Peroxymonophosphoric acid was prepared as in Run 1, but using the 10 following initial mixture:

| | |
|---|---|
| 3.90 g | potassium peroxydiphosphate; |
| 6.0 g | 70% nitric acid; |
| 19.8 g | distilled reverse-osmosis water. |

After cooling, 1.2 g of sodium hydroxide was added to the reacted mixture to produce a pH of 0.9, and the solution was then analyzed and found to contain. 3.6% peroxymonophosphoric acid. A 25.3 g portion of this solution was added to the 1.07 g of acid-pre-treated, air-dried aspen wood, and the mixture held at room temperature (22° C.) for 40 hours. Extraction, washing, drying and analytical procedures were performed as in Run 1.

Example 3

Delignification of Aspen Wood at Elevated pH without Pre-treatment.

Run 15

No acid pre-treatment was employed in Runs 15 through 23. Peroxymonophosphoric acid was prepared as in Run 1 of Example 1, but using the following initial mixture:

| | |
|---|---|
| 3.91 g | potassium peroxydiphosphate; |
| 6.0 g | 70% nitric acid; |
| 18.8 g | distilled reverse-osmosis water. |

After cooling, 1.8 g of sodium hydroxide was added to the reaction mixture to produce a pH of 2.2, and the solution was then analyzed. It contained 3.7% peroxymonophosphoric acid. This solution was used to delignify milled aspen wood as in Run 1, except that a reaction temperature of 50° C. and a reaction time of 5 hours were employed. Results for this Run and all other runs of Example 3 are given in Table 1.

Run 16

No acid pre-treatment was used. Peroxymonophosphoric acid was prepared as in Run 15, except that 1.9 g of sodium hydroxide was added to the cooled reaction mixture to produce a pH of 4.2. This solution was used to delignify milled aspen wood as in Run 15, except that a reaction time of 25 hours was used.

Run 17

No acid pre-treatment was used. Peroxymonophosphoric acid was prepared as in Run 1, but using the following initial 15 mixture:

| | |
|---|---|
| 3.92 g | potassium peroxydiphosphate; |
| 6.0 g | 70% nitric acid; |
| 20.4 g | distilled reverse osmosis water. |

This produced a solution containing 3.8% peroxymonophosphoric acid. This solution was used to delignify milled aspen wood as in Run 1, except that a reaction temperature of 60° C. and a reaction time of 1 hour were employed.

Run 18

No acid pre-treatment was used. Peroxymonophosphoric acid was prepared as in Run 17, except that, after cooling, 1.2 g of sodium hydroxide was added to the reaction mixture to give a pH of 1.0. The solution contained 3.7% peroxymonophosphoric acid and was used to delignify milled aspen wood as in Run 1, except that the reaction temperature was 60° C. and the reaction time was 4 hours.

Run 19

No acid pre-treatment was used. Peroxymonophosphoric acid was prepared as in Run 17, except that, after cooling, 1.5 g of sodium hydroxide was added to the reaction mixture to give a pH of 1.5. The reaction conditions employed were the same as those of Run 18.

Run 20

No acid pre-treatment was used. Peroxymonophosphoric acid was prepared as in Run 17, except that, after cooling, 1.7 g of sodium hydroxide was added to the reaction mixture to give a pH of 2.5. The reaction conditions employed were the same as those of Run 18.

Run 21

No acid pre-treatment was used. Peroxymonophosphoric acid was prepared as in Run 17, except that, after cooling, 2.0 g of sodium hydroxide was added to the reaction mixture to give a pH of 4.3. The reaction conditions employed were the same as those of Run 18, except that a reaction time of 25 hours was used.

Run 22

No acid pre-treatment was used. Peroxymonophosphoric acid was prepared as in Run 17, except that, after cooling, 1.8 g of sodium hydroxide was added to the reaction mixture to give a pH of 2.8. The reaction conditions employed were the same as those of Run 20, except that a reaction temperature of 80° C. was used.

Run 23

No acid pre-treatment was used. Peroxymonophosphoric acid was prepared as in Run 17, except that, after cooling, 2.0 g of sodium hydroxide was added to the reaction mixture to give a pH of 4.1. The reaction conditions employed were the same as those of Run 22, except that a reaction temperature of 5 hours was employed.

Example 4

Delignification of Spruce Wood without Pretreatment.

Run 1

No acid pre-treatment was used. Peroxymonophosphoric acid was prepared and analyzed as in Run 1 of Example 1, but using the following initial mixture:

| | |
|---|---|
| 3.95 g | potassium peroxydisphosphate; |
| 6.1 g | 70% nitric acid; |
| 21.0 g | distilled reverse-osmosis water. |

A solution containing 3.7% peroxymonophosphoric acid was produced. Spruce wood meal, 1.07 g air dried (6.9% moisture) which passed through a 40-mesh screen, was mixed with 25.0 g of the above solution and held at room temperature (22° C.) for 16 hours. The reaction mixture was then processed as in Run 1 of Example 1. The results of this delignification run, and Run 2 of Example 4, are given in Table II.

Run 2

No acid pre-treatment was used. Peroxymonophosphoric acid was prepared and analyzed as in Run 1 of Example 1, but using the following initial mixture:

| | |
|---|---|
| 5.02 g | potassium peroxydisphosphate; |
| 6.0 g | 70% nitric acid; |
| 19.1 g | distilled reverse-osmosis water. |

This produced a solution containing 5.0% peroxymonophosphoric acid. The solution and spruce wood meal were processed as in Run 1 of this Example, except that a reaction time of 40 hours was used.

Example 5

Delignification of Pine Kraft Pulp

Run 1

Peroxymonophosphoric acid was prepared and analyzed as in Run 1 of Example 1, but using the following initial mixture:

| | |
|---|---|
| 1.91 g | potassium peroxydiphosphate |
| 8.9 g | 70% nitric acid; |
| 29.3 g | distilled reverse-osmosis water. |

This produced a solution containing 1.3% peroxymonophosphoric acid. Mixed northern pine kraft pulp, 3.38 g, with 69.3% moisture, was mixed with 22.7 g of the above solution and held at room temperature (22° C.) for 6 hours. The mixture was then processed as in Run 1 of Example 1. No acid pre-treatment was used. Results of this Run and all other runs of Example 5, are given in Table III.

Run 2

Mixed northern pine kraft pulp was delignified using exactly the same conditions as in Run 1 of this Example, except that the reaction time was 16 hours.

Run 3

Mixed northern pine kraft pulp was delignified using exactly the same conditions as in Run 1 of this Example, except that the reaction time was 72 hours.

Run 4

Peroxymonophosphoric acid was prepared and analyzed as in Run 1 of Example 1, but using the following initial mixture:

| | |
|---|---|
| 3.91 g | potassium peroxydiphosphate |
| 6.0 g | 70% nitric acid; |
| 20.2 g | distilled reverse-osmosis water. |

This produced a solution containing 3.8% peroxymonophosphoric acid. The solution and pine kraft pulp were processed as in Run 1 of this Example, except that a reaction time of 2 hours was used.

Run 5

An acid pre-treatment was used. This pre-treatment was performed as follows: 14 g of a pH 0.8 sulfuric acid solution (made by adding 0.77 g of 97% sulfuric acid to 99 g distilled reverse osmosis water) was added to 3.31 g of mixed northern pine kraft pulp (69.3% moisture). The mixture was held for 30 minutes at room temperature (22° C.) and then filtered using a sintered glass crucible. The pulp was then washed several times with distilled reverse osmosis water and then de-watered in the crucible to 70% moisture. The de-watered pulp was then delignified using exactly the same conditions as in Run 2 of this Example.

Run 6

Acid pre-treatment was performed exactly as in Run 5 of this Example. Peroxymonophosphoric acid was prepared and analyzed as in Run 1 of Example 1, but using the following initial mixture:

| | |
|---|---|
| 1.97 g | potassium peroxydiphosphate; |
| 3.0 g | 70% nitric acid; |
| 10.1 g | distilled reverse-osmosis water. |

This produced a solution containing 3.8% peroxymonophosphoric acid. The delignification was carried out as in Run 5, except that only 10.2 g of the solution was added to the acid-pretreated pine pulp.

Run 7

Acid pre-treatment was performed exactly as in Run 5 of this Example. Peroxymonophosphoric acid was prepared and analyzed as in Run 1 of Example 1, but using the following initial mixture:

| | |
|---|---|
| 3.90 g | potassium peroxydiphosphate; |
| 3.1 g | 70% nitric acid; |
| 10.0 g | distilled reverse-osmosis water; |

This produced a solution containing 4.8% peroxymonophosphoric acid. The delignification was carried out as in Run 6 of this Example; however, the increased proportion of the potassium salt raised the pH of the solution to a value of 0.6.

Run 8

Acid pre-treatment was performed exactly as in Run 5 of this Example. Peroxymonophosphoric acid was prepared and analyzed as in Run 1 of Example 1, but using the following initial mixture:

| | |
|---|---|
| 3.91 g | potassium peroxydiphosphate; |
| 5.0 g | 70% nitric acid; |
| 10.0 g | distilled reverse-osmosis water. |

This produced a solution containing 5.8% peroxymonophosphoric acid. The increased acid resulted in a pH of –0.3. The delignification was carried out as in Run 6 of this Example.

Run 9

Acid pre-treatment was performed exactly as in Run 5 of this Example. Peroxymonophosphoric acid was prepared and analyzed as in Run 1 of Example 1, but using the following initial mixture:

| | |
|---|---|
| 3.91 g | potassium peroxydiphosphate; |
| 6.0 g | 70% nitric acid; |
| 20.2 g | distilled reverse-osmosis water. |

This produced a solution containing 3.7% peroxymonophosphoric acid. The delignification was carried out as in Run 5 of this Example, except that a reaction time of 2 hours was employed.

Run 10

Acid pre-treatment was performed exactly as in Run 5 of this Example. The pre-treated pulp was then delignified using exactly the same conditions as in Run 9 of this Example, except that the reaction time was 4 hours.

Run 11

Acid pre-treatment was performed exactly as in Run 5 of this Example. The pre-treated pulp was then delignified using exactly the same conditions as in Run 9 of this Example, except that the reaction time was 16 hours.

Example 6

Delignification of Aspen Chips with Alkaline Pretreatment.

Run 1

To delignify aspen chips with peroxymonophosphoric acid, it was necessary to increase the permeability of the wood using an alkaline pre-treatment. This pre-treatment was performed as follows: 30.0 g of a 5.0% sodium hydroxide solution was added to 3.12 g of 13-mm aspen chips having a moisture content of 43.7%. The mixture was then subjected to a 700-mm vacuum, and held under the vacuum for 24 hours. The solution was then drained from the chips and the chips washed with distilled reverse-osmosis water until the water was pH neutral. No acid pre-treatment was performed.

Peroxymonophosphoric acid was prepared as in Run 1 of Example 1, but using the following initial mixture:

| | |
|---|---|
| 6.7 g | potassium peroxydiphosphate; |
| 8.0 g | 70% nitric acid; |
| 25.3 g | distilled reverse-osmosis water. |

This produced a solution containing 4.9% peroxymonophosphoric acid. The well-drained, alkali pre-treated chips were mixed with 28.4 g of the solution and held for 48 hours at room temperature (23° C.). They were then washed with distilled reverse-osmosis water and extracted, as in Run 1 of Example 1, with 1% sodium hydroxide solution at 50° C. The chips fiberized upon extraction. After extraction, the pulp was thoroughly washed and then dried in a vacuum oven at 60° C. for 16 hours and subsequently weighed and analyzed. Results for Runs 1 and 2 of this Example are given in Table IV.

Run 2

To determine pulp strength and brightness, a larger sample of aspen chips (89.1 g) was subjected to the identical techniques and conditions employed in Run 1 of this Example. A strong, bright pulp, which contained only 1.7% lignin, was obtained.

The above examples show that delignification of lignocellulosics is achievable over a broad range of lignocellulosics and a broad range of delignification conditions. An alkaline extraction after the peroxymonophosphoric acid treatment greatly enhances the removal of the fragmented lignin from the lignocellulosic material. The high residue yields and high viscosities at low lignin contents illustrate the high selectivity of this method of delignification. The following data from Run 2 of Example 6 illustrate that strong, bright pulps having high yields can be obtained using the methods of the present invention.

| Pulp Properties at 290 ml. CSF | |
|---|---|
| Tensile Index Nm/g | 104 |
| Burst Index $kPam^2/g$ | 6.5 |
| Tear Index $mNm^2/g$ | 5.5 |
| ISO Brightness, % | 66 |

Example 7

Comparison with Other Inorganic Peracids

Peroxymonophosphoric acid was prepared and analyzed as in Run 4 of Example 1. The delignification was carried out as in Run 4 of Example 1. Results are given in Table V. The results are compared with results from delignification of aspen wood with peroxymonosulfuric acid and with pernitric acid. The peroxymonosulfuric acid was prepared by dissolving Oxone ($2KHSO_5.KHSO_4.K_2SO_4$) in water and adding nitric acid. The pernitric acid was prepared by adding cooled 70% hydrogen peroxide to 90% nitric acid cooled in an ice bath. The solutions were analyzed as in Run 1 of Example 1.

Table V shows that peroxymonophosphoric acid is, by far, the most efficient and selective delignifying agent of the three inorganic peroxides considered. The residue viscosity is much higher at a lower lignin content than for the other two peracids. It has been found that strong pulps can be obtained by delignifying aspen hardboard fiber and sodium hydroxide pretreated aspen chips with peroxymonosulfuric acid (Proceedings, 1994 TAPPI Pulping Conference, Nov. 6–10, San Diego, Calif., Book 2, Pgs. 543–551). Given the high residue viscosity, even stronger pulps can be obtained by delignification with peroxymonophosphoric acid. As shown by Run 2 of Example 6, even without bleaching, a strong, bright pulp is obtained by peroxymonophosphoric acid treatment, followed by alkaline extraction., of alkaline pretreated aspen chips.

TABLE I

Aspen Wood - 19.9% lignin (through 40 mesh) (Examples 1–3)

| Run | Acid Pretreated | PMP[1] in Initial Solution % | Liquor to Wood Ratio | PMP Consumed % | Initial pH[2] | Reaction Temperature °C. | Reaction Time Hr. | Residue Yield % | Lignin in Residue % | Lignin Removed % | 0.5% CED Viscosity[3] mPa · s |
|---|---|---|---|---|---|---|---|---|---|---|---|
| 1 | No | 1.0 | 25:1 | 91 | –0.1 | 22 | 16 | 70 | 9.0 | 68 | — |
| 2 | No | 1.9 | 25:1 | 90 | 0 | 22 | 16 | 61 | 2.2 | 93 | 23 |
| 3 | No | 3.8 | 10:1 | 98 | 0.3 | 22 | 16 | 62 | 2.4 | 92 | 32 |
| 4 | No | 3.8 | 25:1 | 47 | 0.3 | 22 | 6 | 63 | 1.4 | 95 | 51 |
| 5 | No | 3.2 | 25:1 | 86 | 0 (s)[2] | 22 | 22 | 60 | 0.1 | 99 | 40 |
| 6 | No | 3.4 | 25:1 | 93 | 0 (s)[2] | 22 | 48 | 59 | 0.7 | 98 | 32 |
| 7 | No | 3.8 | 50:1 | 25 | 0.2 | 22 | 4 | 62 | 1.6 | 95 | 42 |
| 8 | No | 3.8 | 25:1 | 59 | 2.2 | 22 | 600 | 61 | 2.2 | 93 | 10 |
| 9 | No | 3.8 | 25:1 | 100 | 4.3 | 22 | 169 | 79 | 19.0 | 25 | — |
| 10 | Yes | 3.8 | 10:1 | 99 | 0 | 22 | 16 | 63 | 1.8 | 94 | 34 |
| 11 | Yes | 3.8 | 25:1 | 46 | 0.2 | 22 | 6 | 61 | 1.6 | 95 | 61 |
| 12 | Yes | 3.7 | 25:1 | 69 | –0.2 | 22 | 16 | 60 | 1.3 | 96 | 31 |
| 13 | Yes | 3.8 | 50:1 | 20 | 0.2 | 22 | 3 | 65 | 2.9 | 90 | 54 |
| 14 | Yes | 3.6 | 25:1 | 28 | 0.9 | 22 | 40 | 68 | 6.8 | 77 | — |
| 15 | No | 3.7 | 25:1 | 7 | 2.2 | 50 | 5 | 85 | 20.1 | 14 | — |
| 16 | No | 3.7 | 25:1 | 100 | 4.3 | 50 | 25 | 76 | 18.2 | 31 | — |
| 17 | No | 3.8 | 25:1 | 81 | 0.4 | 60 | 1 | 55 | 0.5 | 98 | 15 |
| 18 | No | 3.7 | 25:1 | 68 | 1.0 | 60 | 4 | 59 | 1.3 | 96 | 12 |
| 19 | No | 3.7 | 25:1 | 38 | 1.5 | 60 | 4 | 67 | 9.1 | 69 | — |
| 20 | No | 3.7 | 25:1 | 22 | 2.5 | 60 | 4 | 80 | 17.3 | 31 | — |
| 21 | No | 3.7 | 25:1 | 100 | 4.3 | 60 | 25 | 76 | 17.9 | 32 | — |
| 22 | No | 3.1 | 25:1 | 93 | 2.8 | 80 | 4 | 80 | 24.0 | 4 | — |
| 23 | No | 3.5 | 25:1 | 100 | 4.1 | 80 | 5 | 79 | 20.3 | 20 | — |

[1]PMP = peroxymonophoshoric acid
[2](s) indicates that sulfuric acid was used in preparing the PMP.
[3]TAPPI Method T230 om-82

TABLE II

Spruce Wood - 29.1% Lignin (through 40 mesh) (Example 4)

| Run | Acid Pretreated | PMP Initial Solution % | Liquor to Wood Ratio | PMP Consumed % | Initial pH | Reaction Temp. °C. | Reaction Time (Hr.) | Residue Yield % | Lignin in Residue % | Lignin Removed % | 0.5% CED Viscosity[1] mPa · s |
|---|---|---|---|---|---|---|---|---|---|---|---|
| 1 | No | 3.7 | 25:1 | 70 | 0.1 | 22 | 16 | 71 | 8.2 | 80 | 22 |
| 2 | No | 5.0 | 25:1 | 78 | 0.1 | 22 | 40 | 60 | 0.7 | 99 | 15 |

[1]TAPPI Mediod T230 om-82

TABLE III

Pine Kraft Pulp - 5.1% Lignin - 38 mPa's Initial Viscosity (Example 5)

| Run | Acid Pretreated | PMP in Initial Solution % | Liquor to Pulp Ratio | PMP Consumed % | Initial PH | Reaction Temperature °C. | Reaction Time Hr. | Residue Yield % | Lignin in Residue % | Lignin Removed % | 0.5% CED Viscosity[1] mPa · s |
|---|---|---|---|---|---|---|---|---|---|---|---|
| 1 | No | 1.3 | 25:1 | 29 | –0.2 | 22 | 6 | 97 | 2.2 | 59 | 31 |
| 2 | No | 1.3 | 25:1 | 45 | –0.2 | 22 | 16 | 95 | 1.5 | 73 | 27 |
| 3 | No | 1.2 | 25:1 | 83 | –0.2 | 22 | 72 | 92 | 0.6 | 88 | 12 |
| 4 | No | 3.8 | 25:1 | 13 | –0.1 | 22 | 2 | 96 | 2.8 | 47 | 37 |
| 5 | Yes | 1.3 | 25:1 | 48 | –0.2 | 22 | 16 | 93 | 1.1 | 80 | 25 |
| 6 | Yes | 3.8 | 10:1 | 46 | –0.2 | 22 | 16 | 94 | 0.4 | 92 | 26 |
| 7 | Yes | 4.8 | 10:1 | 10 | 0.6 | 22 | 16 | 95 | 1.9 | 65 | 33 |
| 8 | Yes | 5.8 | 10:1 | 47 | –0.3 | 22 | 16 | 94 | 0.4 | 93 | 20 |
| 9 | Yes | 3.7 | 25:1 | 14 | –0.1 | 22 | 2 | 96 | 3.4 | 35 | 39 |
| 10 | Yes | 3.7 | 25:1 | 15 | –0.2 | 22 | 4 | 95 | 2.3 | 57 | 36 |
| 11 | Yes | 3.7 | 25:1 | 29 | –0.2 | 22 | 16 | 93 | 0.5 | 90 | 26 |

[1]TAPPI Method T230 om-82

TABLE IV

| Run | Acid Pretreated | PMP in Initial Solution % | Liquor to Pulp Ratio | PMP Consumed % | Initial PH | Reaction Temperature °C. | Reaction Time Hr. | Residue Yield % | Lignin in Residue % | Lignin Removed % | 0.5% CED Viscosity mPa · s |
|---|---|---|---|---|---|---|---|---|---|---|---|
| | | | | Aspen Chips - NaOH Pretreated - 19.9% Lignin (Example 6) | | | | | | | |
| 1 | No | 4.9 | 17:1 | 86 | 0.3 | 23 | 48 | 60 | 1.3 | 96 | 40 |
| 2 | No | 4.9 | 17:1 | 90 | 0.3 | 23 | 48 | 61 | 1.7 | 95 | 36 |

TABLE V

| Oxidant: | Peroxymonophosphoric Acid $H_3PO_5$ | Peroxymonosulfuric Acid $H_2SO_5$ | Pernitric Acid $HNO_4$ |
|---|---|---|---|
| | Comparison of Peracid Delignification of Aspen Wood (through 40 mesh) (Example 7) | | |
| REACTION CONDITIONS: | | | |
| Quantity Applied, g [0]*/g wood | 0.13 | 0.13 | 0.12 |
| Quantity Consumed, g [0]/g wood | 0.063 | 0.046 | 0.12 |
| Acid Concentration, Normality | 2.2 | 2.2 | 2.2 |
| Reaction Time, Hr. | 6.0 | 6.6 | 6.0 |
| Reaction Temperature, °C. | 22 | 22 | 22 |
| RESULTS: | | | |
| Residue Yield, % | 63 | 68 | 70 |
| Lignin in Residue, % | 1.4 | 5.8 | 9.9 |
| 0.5% CED Viscosity mPa · s | 36 | 24 | 9 |

*[0] indicates active oxygen (one oxygen atom in each peracid molecule is active)

I claim:

1. A method of oxidatively treating a lignocellulosic material to decrease a content of lignin therein, the method comprising the steps of:

(a) contacting the lignocellulosic material with a solution of peroxymonophosphoric acid having a pH in the range of −0.5 to 7, a peroxymonophosphoric acid weight concentration of about 0.1 to a 20% based on solution, at a temperature of 0° to 200° C., for a time from about 0.1 to about 1200 hours and a solution to lignocellulosic material mass ratio of 1:1 to 100:1, to substantially fragment the lignin in the lignocellulosic material and form a solid lignocellulosic residue containing lignin;

(b) separating the solid lignocellulosic residue from the solution; and (c) extracting the fragmented lignin from the solid lignocellulosic residue.

2. The method of claim 1 wherein the lignocellulosic material is selected from the group consisting of wood, straw, sugar cane bagasse, kenaf, reeds, corn stover, flax, hemp, and prepared wood material.

3. The method of claim 2 wherein the prepared wood material comprises porosity-enhanced wood chips, fiberized wood, chemical wood pulp, high yield pulp, waste paper, or recycled fibers.

4. The method of claim 1 wherein the lignin extraction is carried out in a dilute alkaline solution.

5. The method of claim 4 wherein the lignin extraction is carried out in a solution of ammonium hydroxide.

6. The method of claim 1 wherein the lignin content of the lignocellulosic material is decreased by about 5 to about 99 percent.

7. The method of claim 1 which further comprises the additional step of contacting the lignocellulosic material with a strongly acidic solution prior to contacting the lignocellulosic material with the peroxymonophosphoric acid solution.

8. The method of claim 7 which further comprises the additional step of first contacting the lignocellulosic material with a strongly alkaline solution prior to contacting the material with a strongly acidic solution.

9. The method of claim 1 which further comprises the additional step of contacting the lignocellulosic material with a solution of a chelating agent prior to contacting the lignocellulosic material with the peroxymonophosphoric acid solution.

10. The method of claim 9 which further comprises the additional step of contacting the lignocellulosic material with a strongly alkaline solution prior to contacting the material with a solution of a metal chelating agent.

11. The method of claim 1 which further comprises the additional step of contacting the lignocellulosic material with a strongly alkaline solution prior to contacting the lignocellulosic material with the peroxymonophosphoric acid solution.

12. The method of claim 1 which comprises a further step of bleaching the delignified residue.

13. A method of oxidatively treating a chemical pulp comprising lignocellulosic material to decrease a content of lignin therein and improve the optical brightness of the pulp, wherein the pulp is prepared by pulping processes, the method comprising the steps of:

(a) contacting the pulp with a solution of peroxymonophosphoric acid having a pH in the range of −0.5 to 7, a peroxymonophosphoric acid weight concentration of about 0.1 to 20% based on solution, at a temperature of 0° to 200° C., for a time from about 0.1 to about 1200 hours and a solution to pulp mass ratio 1:1 to 100:1, to substantially fragment the lignin in the pulp and form a solid lignocellulosic residue containing lignin;

(b) separating the solid lignocellulosic residue from the solution; and (c) extracting the fragmented lignin from the solid lignocellulosic residue.

14. The method of claim 13 which comprises a further step of bleaching the delignified pulp.

15. The method of claim 13 wherein the method comprises the additional step of contacting the pulp with a strongly acidic solution prior to contacting the pulp with the peroxymonophosphoric acid solution.

16. The method of claim 13 which further comprises the additional step of contacting the pulp with a solution of a chelating agent prior to contacting the pulp with the peroxymonophosphoric acid solution.

17. The method of claim 14 wherein the bleached pulp has an ISO brightness of at least 60 after bleaching.

* * * * *